United States Patent [19]

Yokoyama et al.

[11] Patent Number: 4,461,627

[45] Date of Patent: Jul. 24, 1984

[54] UPGRADING METHOD OF LOW-RANK COAL

[75] Inventors: Hiroshi Yokoyama; Toshio Kuge; Shunsuke Nogita, all of Hitachi; Yoichi Nakamura, Kudamatsu, all of Japan

[73] Assignee: Hitachi, Ltd., Tokyo, Japan

[21] Appl. No.: 449,195

[22] Filed: Dec. 13, 1982

[30] Foreign Application Priority Data

Dec. 18, 1981 [JP] Japan ..... 56-203552
Mar. 3, 1982 [JP] Japan ..... 57-32390

[51] Int. Cl.[3] ..... C10L 5/16

[52] U.S. Cl. ..... 44/23; 44/10 C; 201/5; 201/20; 201/22

[58] Field of Search ..... 44/23, 1 F, 10 C, 24, 44/19, 15 E; 201/6, 22, 23, 5, 20, 21

[56] References Cited

U.S. PATENT DOCUMENTS

| | | | |
|---|---|---|---|
| 3,140,241 | 7/1964 | Work et al. | 44/23 |
| 3,637,464 | 1/1972 | Walsh et al. | 44/10 C |
| 3,980,447 | 9/1976 | Franke et al. | 201/6 |
| 4,018,571 | 4/1977 | Cole et al. | 44/24 |
| 4,082,515 | 4/1978 | Capes et al. | 44/1 F |
| 4,153,419 | 5/1979 | Clayfield et al. | 44/6 |
| 4,234,320 | 11/1980 | Verschuur | 44/24 |
| 4,362,532 | 12/1982 | Wasson et al. | 44/23 |

*Primary Examiner*—Delbert E. Gantz
*Assistant Examiner*—Anthoy McFarlane
*Attorney, Agent, or Firm*—Antonelli, Terry & Wands

[57] ABSTRACT

A coal is finely pulverized. The finely pulverized coal is subjected to dry distillation. A tar obtained by the dry distillation is added to an aqueous slurry together with the dry-distilled coal to effect the submerged granulation.

8 Claims, 3 Drawing Figures

UPGRADING METHOD OF LAW-RANK COAL

BACKGROUND OF THE INVENTION

1. Field of the Invention

The present invention relates to an upgrading method of a low-rank coal such as brown coal, lignite or sub-bituminous coal.

2. Description of the Prior Art

Coals are used generally as fuels or starting materials in the chemical industry. The major part of them is high-rank coals such as bituminous coal. About ¼ of the total coals produced all over the world is low-rank coals such as brown coal. However, they are not used practically satisfactorily, since some of them have a water content of as high as 70%.

As processes for reducing the water content of coal, there has been known a process for heat-treating coal disclosed in the specification of Japanese Patent Publication No. 11596/1982 of Mitsubishi Heavy Industry Co., Ltd. laid open on Dec. 16, 1980. This process is characterized in that coal is heated to a final temperature of 300° to 500° C. rapidly at a temperature rise rate of at least 100° C./min and then it is cooled rapidly to 250° C. or lower at a temperature lowering rate of at least 50° C./min. In this known process, it is difficult to dehydrate a large amount of coal at once owing to the specific temperature control of coal required.

Some of the low-rank coals have an ash content of as high as more than 20%. For the removal of ash from low-rank coals, there may be mentioned a process disclosed in the specification of Shell Oil's U.S. Pat. No. 4,153,419 "Agglomeration of coal fines" granted on May 8, 1979. However, this patent teaches merely a technique of combining a previously prepared tar with coal fines and agglomerating only the coal fines in an aqueous slurry. The object of this patent is not the dehydration of coal.

SUMMARY OF THE INVENTION

An object of the present invention is to provide a process for removing water and ash easily from a large amount of a low-rank coal.

According to the present invention, a coal is finely pulverized and subjected to dry distillation to obtain a tar, the coal thus distilled is added to an aqueous alurry to granulate the same in water using the tar distilled out in the former step as binder, whereby water and ash can be removed easily from the coal.

For the better understanding of the present invention, the invention will be illustrated below.

DESCRIPTION OF THE PREFERRED EMBODIMENTS

Figure 1:
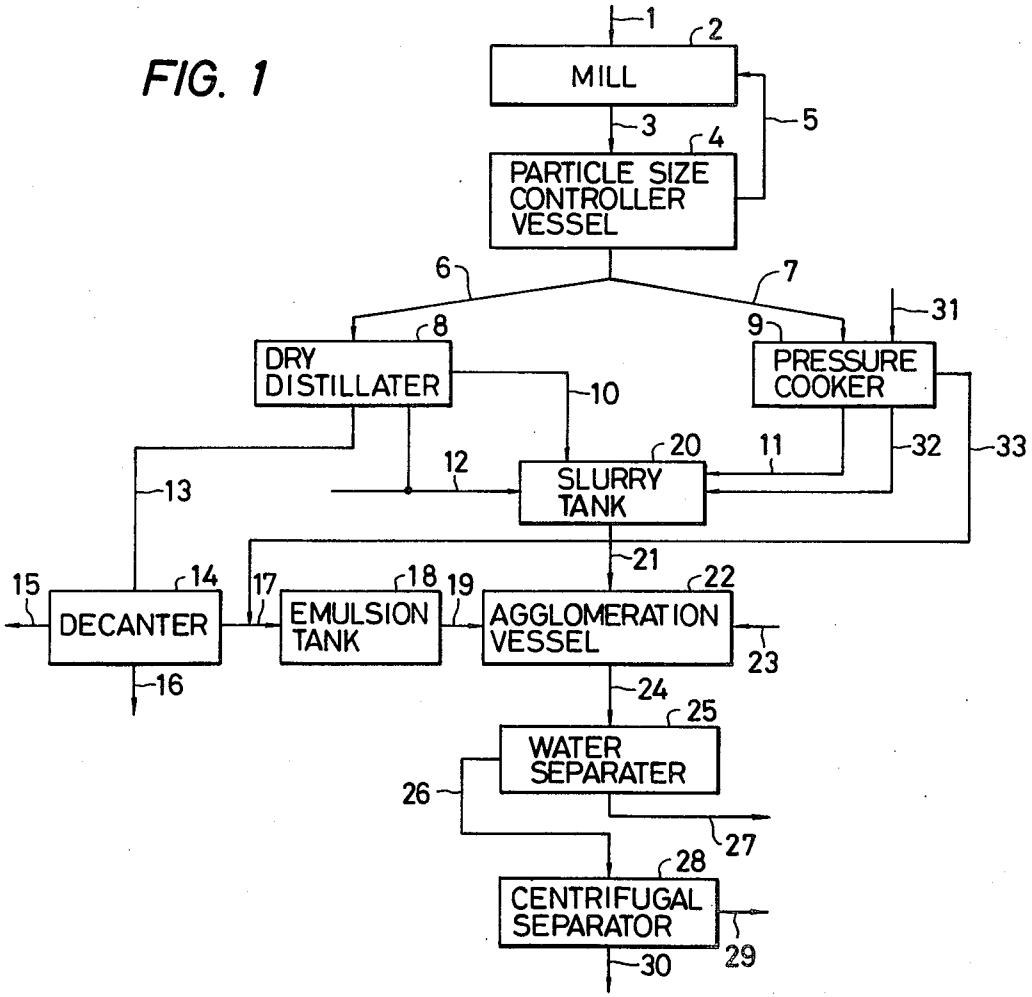
FIG. 1 is a flow sheet showing the upgrading method of coal according to the present invention.

The term "coals" herein refers to untreated brown coal, lignite and sub-bituminous coal. For example, raw brown coal has a carbon content (C%) of up to 78% and a calorific value of 7300 kcal/kg (on dry basis). The process of the present invention comprises the following four steps.

The first step comprises fine pulverization of coal.

In the second step, the coal finely pulverized in the first step is subjected to dry distillation to distill water and tar. It is desirable to determine the amount of the coal to be dry-distilled so that the amount of the tar obtained by the dry distillation would be at least 2% based on the coal component in the total amount of the coal. The term "coal component" refers to a residue remaining after the removal of ash and water from coal. If the amount of tar is smaller, efficient agglomeration in the fourth step which will be shown below becomes impossible and recovery of the coal is reduced. The dry distillation temperature of, for example, raw brown coal is 200° to 600° C., particularly preferably 350° and 500° C. If the dry distillation temperature is lower than that, the amount of the distillate is insufficient, while if it is higher than that, the distilled tar is thermally decomposed.

In the dry distillation carried out in the second step, the treatment is effected continuously at a constant temperature. Therefore, as compared with the known process disclosed in the specification of Japanese Patent Publication No. 11596/1982, the temperature control in the dry distillation is easy in the present invention.

The water content of the coal can be reduced to about 7% in the second step of the present invention.

In the third step, an aqueous slurry is formed from the dry-distilled coal and then the tar distilled out in the second step is added as a binder to the aqueous slurry to agglomerate the coal particles. As a matter of course, water distilled out together with tar in the second step may be utilized as water for the preparation of the aqueous slurry. A surfactant may be used in this step for reducing the amount of the tar and saving the stirring power for the coagulation. It is a merit of this step of the agglomerating of fine coal particles that the fine ash particles are not agglomerated because they are hydrophilic, and the deashed fine coal particles are agglomerated. It is considered generally that ash particles cannot be separated to a high degree, since tar obtained from coal contains certain groups lyophilic for not only carbon particles but also fine ash particles. However, the inventors have found that this idea is true only in case of bituminous coals having an ash content of 20% or higher. Brown coals have a low ash content in general and many of them have an ash content of up to several percent. According to the inventor's finding, the deashing effect is exerted on also brown coals having such a low ash content of up to several % in the third step. When the crude coal has an ash content of 5 to 6%, the ash content of the agglomerated brown coal can be reduced to about 1 to 3%.

In the fourth step, the granules formed by agglomeration are separated from water. The granules in this step have a diameter of generally 0.3 to 5 cm. They can be separated from water easily by a suitable means such as a vibration sieve or centrifugal separator which exhibits a high dehydration effect. According to the present invention, tar required for removing ash from coal is obtained by the dry distillation of coal and the coal is agglomerated in water to reduce the water content of the coal after completion of the fourth step to about 12%, to obtain a dehydration rate of about 60% and to attain a deashing rate of about 30 to 35%. In addition, reduction in the oxygen atom content of coal by the heat treatment brings about an effect of increasing a calorific value per unit weight during the burning.

Figure 2:
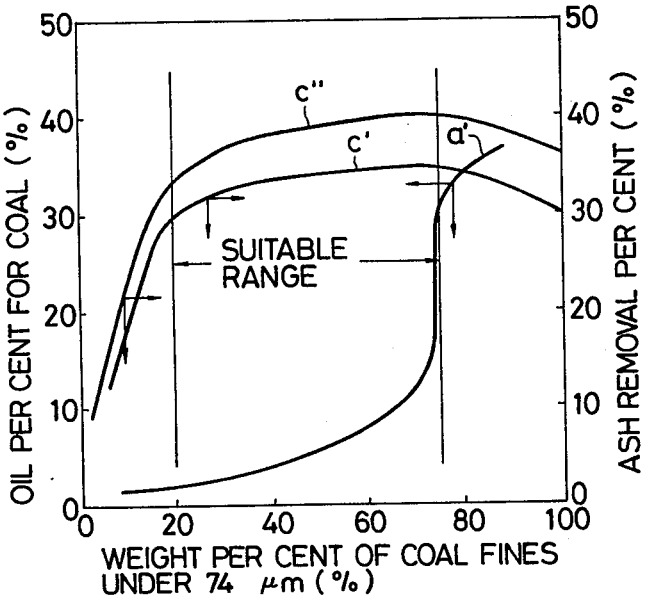
FIG. 2 is a graph showing relationships between the amount of particles of up to 74μ in fine coal powder introduced in a slurry-preparing tank and the quantity of oil added to an aqueous slurry and deashing rate.

In the present invention, the amount of tar obtained in the second step is controlled at 2 to 30%, preferably 4 to 25%, based on the total amount of the coal finely pulverized in the first step for increasing the deashing rate. Thus, the deashing rate can be increased to 30 to 35% as shown in FIG. 2-c'. Another effect of the invention is that the dehydration treatment is facilitated as described above.

In the second step of the upgrading method of coal according to the present invention, the total coal finely pulverized in the first step is subjected to dry distillation. It is also possible, however, to send part of coal finely pulverized in the first step in a dry distillator and to send the balance to a non-evaporating heating dehydrator so as to remove water and to distill tar. In the dehydration of coal, the non-evaporating heating temperature is preferably 180° to 350° C. under a pressure of 8 to 160 kg/cm$^2$. Low-quality coals are hydrophilic in many cases, since they contain chemically bonded oxygen atoms. This is one of the reasons for the high water content of the coal. Oxygen-containing groups are decomposed at a temperature of above 180° C. according to a decarboxylation reaction or the like. At a temperature above 350° C., the coal structure itself is thermally decomposed. The inventors have found after the experiments that almost all raw brown coals can be reformed and water content thereof can be reduced to 20 to 14% and the dehydration rate can be increased to about 40% by the dehydration through the non-evaporating heating treatment.

In the third step of the present invention which does not include the non-evaporating heating dehydration treatment, the dry-distilled coal in the form of an aqueous slurry is mixed with the non-evaporatingly heated coal to form an aqueous slurry and the tar distilled out in the second step is added as a binder to the aqueous slurry. However, in this embodiment including the non-evaporating heating dehydration, the dry-distilled coal is mixed with the non-evaporatingly heated coal to form an aqueous slurry and the tar extracted in the second step is added as binder to the aqueous slurry to agglomerate the coal particles. Water distilled out together with tar in the second step and water obtained by the non-evaporating heating dehydration treatment may be utilized as the water for the preparation of the aqueous slurry.

The fourth step is the same as above with respect to the separation of water from the agglomerated coal irrespective of the use of non-evaporating heating dehydrator. It is important in this step that water is fed in the non-evaporating heating dehydration device to a level of the upper surface of the finely pulverized coal. Then, the non-evaporating dehydrator is heated under a high pressure to extract 2 to 8%, based on the total amount of the coal, of tar from the fine coal powder in the non-evaporating heater. The tar thus extracted does not adhere to the ash in the fine coal powder in the non-evaporating heating device but is combined with the tar extracted in the second step and used for the agglomeration of the coal particles in the third step. As a result, the deashing rate from the coal granulated in water in the third step in this embodiment is higher than that attained in the above-described case of the invention. Thus, the deashing rate can be increased to as high as 34 to 40%.

As embodiment of the present invention will be illustrated with reference to a case of using the non-evaporating heating dehydrator and to FIG. 1.

A raw coal is fed in a pulverizer 2 through a line 1 and finely pulverized therein. The finely pulverized coal is introduced into a particle size-controlling tank 4 to control the same. Non-pulverized coal is returned into the pulverizer 2 through a line 5 and pulverized again to such a degree that the amount of the particles smaller than 200 mesh (74μ) is up to 60%. Part 6 of the finely pulverized coal is introduced into a dry distillation device 8 and the balance 7 is introduced into a non-evaporating heater 9 . In case the total coal is dry-distilled, the system of the non-evaporating heater 9 is omitted. In the dry distillation device 8, coal 6 is dry-distilled. Distilled water, gas and tar 13 are introduced into a separator 14. In the separator 14, the mixture is divided into gas 15, water 16 and tar 17. On the other hand, water is fed from a system 31 to the non-evaporating heater 9 and heated under a high pressure. The coal and water are sent to a slurry tank 20 through lines 11 and 32, respectively. Dry-distilled coal 10 is also introduced into the slurry tank 20 and required water 12 in addition to water from the dry distillator 8 is fed to the slurry tank 20. Tar 17 from the tar separator 14 is sent to an emulsion-preparation tank 18 together with tar discharged from the non-evaporating heater through line 33 and then stirred therein. If necessary, additives such as a surfactant may be added thereto. The tar from the emulsion-preparation tank 18 is sent to a stirring tank 22 through a line 19 and the aqueous slurry from the slurry tank 20 is sent thereto through a line 21. The coal is subjected to the submerged granulation in the stirring tank 22. The granulated coal is introduced into a separator 25 such as a vibration sieve through a line 24 so as to separate the same from water and the ash particles. The separated, granulated coal is introduced into a centrifugal separator 28 through a line 26 to effect dehydration further. The water and ash separated are discharged through lines 27 and 29 . The deashed coal particles are taken through a line 30.

EXAMPLE 1

1 kg of sub-bituminous coal having a water content of 30.2% and ash content of 11.7% (on dry basis) was finely pulverized in a ball mill. 73% of the resulting fine powder had a particle size of smaller than 200 mesh. 0.3 kg of the powder was dry-distilled at 500° C. for 2 h to obtain 29 g of a tar. The balance (0.7 kg) of the sub-bituminous coal was subjected to the non-evaporating dehydration treatment at 400° C. under pressure for 2 h. From the treated brown coals, a 35% aqueous slurry was formed. The coal particles in the slurry was agglomerated using the tar obtained by the dry distillation as a binder. After the centrifugal separation, 0.62 kg of agglomerated particles was obtained in total. The agglomerated coal had a high quality, i.e. water content of 13.1% and ash content of 6.1%

EXAMPLE 2

The reforming was effected in the same manner as in Example 1 except that a raw brown coal having a water content of 60% and ash content of 2.2% (on dry basis) was used. The product had a high quality, i.e., water content of 18% and ash content of 1.7%. The recovery of the coal component was about 90%.

EXAMPLE 3

1 kg of a raw brown coal having a water content of 60% and ash content of 6.5% (on dry basis) was finely pulverized in a ball mill. 45% of the resulting powder had a particle size of smaller than 200 mesh. 0.5 kg of the powder was dry-distilled at 480° C. for 1.2 h to obtain 14 g of tar. The balance (0.5 kg) of the raw brown coal was subjected to the non-evaporating dehydration treatment at 380° C. under pressure for 1.2 h. From the treated coals, a 30% aqueous slurry was formed. The brown coal particles in the slurry were agglomerated using the tar obtained by the dry distillation as a binder. After the dehydration, the resulting brown coal had a high quality, i.e., water content of 8.9% and ash content of 3.9%.

EXAMPLE 4

The reforming was effected in the same manner as in Example 1 except that a lignite having a water content of 21% and ash content of 21% (on dry basis) was used and that 40% of the total amount of the coal was dry-distilled to obtain a tar in an amount of 7% based on the coal. After the dehydration, the lignite had a high quality, i.e. water content of 14% and ash content of 7%.

EXAMPLE 5

The treatment was effected using the same raw subbituminous coal as in Example 1 in the same manner as in Example 1 except that the total coal was dry-distilled to distill 8 wt. %, based on the coal, of a tar. The coal thus reformed had a high quality, i.e., water content of 7.5% and ash content of 6.0%.

As described above in detail, according to the present invention, the water content of a low-rank coal can be reduced to several to ten-odd percent and, at the same time, deashing can be effected.

The description will be made on the submerged granulation method of the fine coal powder in the stirring tank according to the present invention.

After intensive investigations made for the purpose of elucidating a relationship between the coal particle size and the amount of required oil in the submerged granulation of coal, the inventors have found that a large amount of oil is required for the granulation of fine coal powder containing more than 75 wt. % of particles smaller than 74μ and that if the amount of fine coal powder smaller than 74μ is less than 20%, the deashing rate is low. The present invention has been completed on the basis of these findings.

The inventors made basic experiments for confirming the above-described facts. The relationship between the amount of oil required for the granulation and the deashing rate of fine coal powder was examined from many sides. The results are shown below.

Experiments

A 33% aqueous slurry was prepared from brown coal having controlled particle sizes. An emulsion of an oil, water and surfactant was added to the slurry and the mixture was stirred to effect the submerged granulation. The results of the deashing rate determination are shown in FIG. 2.

Figure 3:
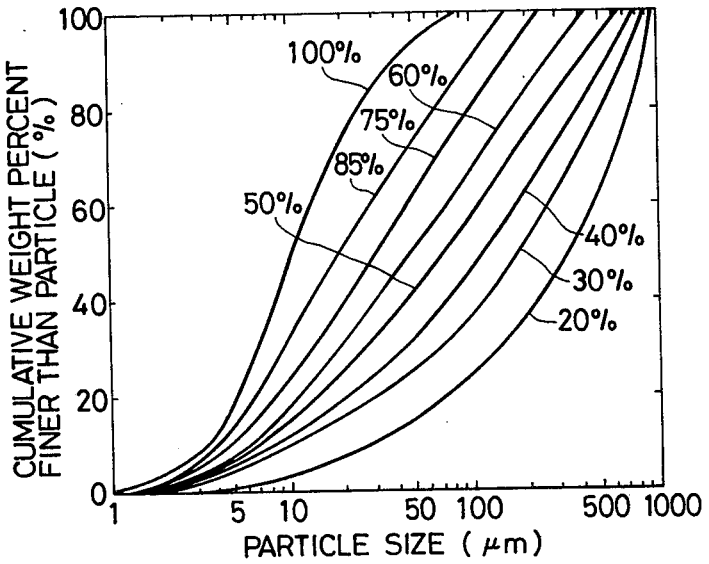
FIG. 3 is a graph showing a relationship between particle size of coal used in the present invention and cumulative weight percent.

FIG. 3 is a graph showing a particle size distribution of the brown coal used in these experiments. The ordinates indicate cumulative weight percents of sieved coal. Numerals 100%, 85%, 75%, 60%, 50%, 40%, 30% and 20% in the figure show proportions of coal paricles smaller than 74μ.

FIG. 2 is a graph showing a relationship between the amount of oil required for the granulation of particles smaller than 74μ and the deashing rate. Curve a' in FIG. 2 shows total oil (tar) percentage for coal in both cases of including and excluding the non-evaporating heating dehydration step. Curves c' and c'' in FIG. 2 show the deashing rates in cases of excluding and including the non-evaporating heating dehydration step, respectively. It is apparent from FIG. 2 that if the amount of the particles smaller than 74μ is larger than 75%, the amount of oil required for the granulation is increased sharply. In the granulation, the oil is added to the aqueous slurry of coal, the mixture is stirred to form an agglomerate of fine coal powder containing the oil as binder, then the agglomerate is consolidated by the rolling action of the stirrer to form granules. A reason why the amount of oil required for the granulation is increased when the amount of the fine powder is larger than 75% is that the surface area of the powder is increased to require the larger amount of the oil as binder.

It will be understood that if the amount of the particles of up to 74μ is below 20%, the deashing rate of the coal granules is reduced. The deashing rate is determined according to the following formula (1):

$$\text{Deashing rate (\%)} = \frac{\left(\begin{array}{l}\text{Ash content before}\\ \text{the granulation}\end{array}\right) - \left(\begin{array}{l}\text{Ash content after}\\ \text{the granulation}\end{array}\right)}{\left(\begin{array}{l}\text{Ash content before}\\ \text{the granulation}\end{array}\right)} \times 100$$

The deashing occurs due to a difference in wettability between the coal and ash. Ash is hydrophilic, while coal is oleophilic. Therefore, fine coal powder is agglomerated preferentially in oil and the non-agglomerated ash particles remain in the liquid. A reason why the deashing rate is reduced with less than 20% of particles smaller than 74μ is that the amount of the coal particles completely separated from the ash is small. It will be understood from the above-mentioned experimental results that if the amount of fine coal particles smaller than 74μ is controlled to 20 to 75% in the granulation, the deashing rate is increased to 34 to 40% and the amount of required oil is reduced. Consequently, it becomes unnecessary to use an excess amount of tar. This fact contributes to the energy saving.

If the total tar amount is less than 2%, the coal granulation becomes impossible. If the amount of total tar is 2%, a deashing rate of about 28% is obtained. If the amount of tar exceeds 30% based on the total amount of coal, the deashing rate is reduced by about 5%, since ash particles are incorporated in the coal to be granulated. Accordingly, the amount of tar should be controlled to 2 to 30% based on the amount of coal for minimizing the reduction in the deashing rate and also for minimizing the amount of tar required in the submerged granulation of coal in the third step.

As the oils used for the submerged granulation of coal, there may be mentioned, in addition to coal tar, hydrocarbons such as light oil, fuel oil and kerosene, lubricating oils such as creosote and anthracene oil and heavy hydrocarbons such as heavy fuel oil.

EXAMPLE 6

1.2 kg of raw brown coal having a water content of 30.6% and ash content of 9.35% (on dry basis) was finely pulverized in a ball mill. Part of the fine powder was subjected to the grain dressing treatment and the balance was used as it was. In the granulation, a 31% aqueous slurry of the fine powder was sent to a stirring tank and a tar emulsion obtained by the dry distillation of brown coal was added to the slurry and the mixture was stirred. The amounts of tar required were 3% and 24% in the granulation of a fine powder having a controlled particle size (the amount of particles smaller than 74μ: 22%) and the one having an uncontrolled particle size (the amount of particles smaller than 74μ: 77%), respectively. The amount of the tar required for the granulation of the powder having a controlled particle size was ⅛ of that of the powder having an uncontrolled particle size. After the granulation, the granules had a diameter of 0.8 to 2.0 mm in both cases. After the centrifugation, 1.1 kg of the coal granules was obtained. The ash contents were 5.9% and 5.6% in the particle size-controlled and uncontrolled cases, respectively.

EXAMPLE 7

1.5 kg of raw brown coal having a water content of 55% and ash content of 6.3% (on dry basis) was finely pulverized in a ball mill. Part of the fine powder was subjected to the grain dressing treatment and the balance was used as it was. In the granulation, a 28% aqueous slurry of the fine powder was sent to a stirring tank and an emulsion of a mixture of fuel oils A and B was added to the slurry. The mixture was stirred. The amounts of the required fuel oils were 5% and 26% in the granulation of a fine powder having a controlled particle size (the amount of the particles smaller than 74μ: 53%) and the one having an uncontrolled particle size (the amount of particles smaller than 74μ: 79%), respectively. The amount of the fuel oils required for the granulation of the particle size-controlled powder was about 1/5 of that of the particle size-uncontrolled powder. After the granulation, the granules had a diameter of 1.0 to 2.3 mm in both cases. After the centrifugation, 1.4 kg of the coal granules was obtained. The ash content was 3.7% in both cases.

EXAMPLE 8

Sub-bituminous coal having a water content of 12% and ash content of 15.6% (on dry basis) was subjected to the submerged granulation treatment in the same manner as in Example 7. The amounts of the fuel oils required were 4.5% in a particle size-controlled case and 24% in a particle size-uncontrolled case. The amount of the fuel oils required in the former case was about 1/5 of that required in the latter case. After the granulation, the granules had a diameter of 1.2 to 2.0 mm in both cases. After the centrifugation, 1.42 kg of the coal granules was obtained. The ash content was 9.1% in both cases.

EXAMPLE 9

1 kg of raw brown coal having a water content of 30.2% and ash content of 8.3% (on dry basis) was finely pulverized in a ball mill. Part of the fine powder was subjected to the grain dressing treatment and the balance was used as it was. In the granulation, a 30% aqueous slurry of the fine powder was sent to a stirring tank and an emulsion of coke oven tar was added to the slurry. The mixture was stirred. The amounts of the tar required for the granulation of the particle size-controlled powder (the amount of the particles smaller than 74μ: 69%) and the particle size-uncontrolled powder (the amount of the particles smaller than 74μ: 89%) were 11% and 34%, respectively. The amount of the tar required in the former case was about ⅓ of that required in the latter case.

After the -ranulation, the granules had a diameter of 1.2 to 3.0 mm in both cases. After the centrifugation, 0.97 kg of the coal granules was obtained. The ash content was 4.8% in both cases.

EXAMPLE 10

0.82 kg of sub-bituminous coal having a water content of 11% and ash content of 16.2% (on dry basis) was finely pulverized in a ball mill. Part of the fine powder was subjected to the grain dressing treatment and the balance was used as it was. In the granulation, a 27% aqueous slurry of the fine powder was sent to a stirring tank and an emulsion of a tar obtained by the dry distillation of coal was added to the slurry. The mixture was stirred. The amounts of the tar required for the granulation of the particle size-controlled powder (the amount of the particles smaller than 74μ: 24%) and the particle size-uncontrolled powder (the amount of the particles smaller than 74μ: 12%) were 3% and 2%, respectively, these amounts being substantially equal. Ash contents were 10.5% in the former case and 13.7% in the later case. This fact clearly indicates the effect obtained by the grain dressing treatment. After the granulation, the granules had a diameter of 1.2 to 2.0 mm in both cases. After the centrifugation, 0.8 kg of the coal granules was obtained.

As described above, an effect of saving the oil required for the granulation of fine coal powder can be obtained in above Examples 6 to 10. Further, Examples 6 to 10 suggest merits of the granulated coals in that they are convenient for transportation and storage and that they have a high calorific value per unit weight.

We claim:

1. An upgrading method for low-rank coal comprising the steps of:

(a) finely pulverizing the coal to provide an amount of coal particles having particle sizes of up to 74μ between 20 and 75 weight %, (b) subjecting the finely pulverized coal to dry distillation at a temperature of from 200° to 600° C. to obtain water, tar and dry-distilled coal, (c) mixing the dry-distilled coal with water to obtain an aqueous slurry, (d) adding the tar obtained by the dry distillation to the slurry to agglomerate coal particles, and (e) separating the agglomerated coal particles from water.

2. An upgrading method for low-rank coal according to claim 1 wherein the dry distillation is effected in such a manner that the amount of tar obtained by the dry distillation is at least 2% based on the coal component in the finely pulverized coal in total.

3. An upgrading method for low-rank coal according to claim 2 further including a step of dry distillation which is carried out in such a manner that the amount of tar obtained by the dry distillation will be up to 30% based on the coal component in the finely pulverized coal in total.

4. An upgrading method for low-rank coal comprising the steps of:

(a) finely pulverizing the coal to provide an amount of coal particles having particle sizes of up to 74μ between 20 and 75 weight %, (b) subjecting part of the finely pulverized coal to dry distillation at a temperature of from 200° 600° C. to obtain water, tar and dry-distilled coal, (c) subjecting the balance of the finely pulverized coal to a non-evaporating heating treatment at a temperature of from 180° to 350° C. to reduce its water content and to distill tar, (d) mixing the dry-distilled coal and the non-evaporatingly heated coal with water to obtain an aqueous slurry, (e) adding the tar obtained by the dry distillation and the non-evaporating heating treatment to the slurry for agglomerating coal particles, and (f) separating the agglomerated coal particles from water.

5. An upgrading method for low-rank coal according to claim 2 wherein the non-evaporating heating treatment comprises steps of:

feeding water to a level of the upper surface of a mass of the finely divided coal and heating the same under an elevated pressure to obtain at least 2%, based on the coal component in the total coal, of a tar, and controlling the total amount of the tar obtained by the dry distillation and the tar obtained by the non-evaporating heating to at least 2% based on the coal component in the total coal.

6. An upgrading method for low-rank coal according to claim 4 wherein the non-evaporating heating is effected in such a manner that the amount of tar obtained by the heating will be up to 8% based on the coal component in the finely pulverized coal in total and the total of the tar obtained by the dry distillation and the non-evaporating heating is controlled to up to 30% based on the coal component in the total coal.

7. An upgrading method for low-rank coal according to claim 1 or 2 wherein the dry distillation of the coal is effected at a constant temperature.

8. An upgrading method for low-rank coal according to claim 2 wherein the non-evaporating heating temperature is conducted under a pressure of 8 to 160 kg/cm$^2$.

* * * * *